United States Patent [19]

Nikolaus et al.

[11] 4,001,985

[45] Jan. 11, 1977

[54] CEILING SUPPORT FRAME WITH PIVOTALLY ATTACHED OUTRIGGERS

[75] Inventors: Harold W. Nikolaus, Columbia; Kenneth L. Wasson, Lancaster, both of Pa.

[73] Assignee: Armstrong Cork Company, Lancaster, Pa.

[22] Filed: Dec. 5, 1975

[21] Appl. No.: 637,899

[52] U.S. Cl. ..... 52/28; 52/488

[51] Int. Cl.[2] ..... E04B 5/62

[58] Field of Search ..... 52/475, 28, 144; 98/40 DL; 240/9 R, 9 A, 51

[56] References Cited

UNITED STATES PATENTS

| | | | |
|---|---|---|---|
| 3,581,448 | 6/1971 | Roux | 52/28 |
| 3,848,385 | 11/1974 | Thompson | 52/28 |

*Primary Examiner*—John E. Murtagh

[57] ABSTRACT

A suspended ceiling is provided having a main grid assembly defining the lower plane of the suspended ceiling and having trusses connected to the grid assembly. A support frame is positioned above the lower main grid assembly defines the upper ceiling plane. Outrigger arms pivotally attached to the ceiling support frame are used to suspend the support frame from the trusses on the main grid assembly and to position the support frame relative to the main grid assembly. A ceiling board is mounted within the support frame and a plurality of ceiling boards are carried by the combination of the main grid assembly and the support frame.

7 Claims, 3 Drawing Figures

CEILING SUPPORT FRAME WITH PIVOTALLY ATTACHED OUTRIGGERS

BACKGROUND OF THE INVENTION

1. Field of the Invention

The invention relates to a ceiling suspended from a main structural ceiling in a room. More particularly, the invention is concerned with a support frame within a suspended ceiling system.

2. Description of the Prior Art

U.S. Pat. No. 3,581,448 discloses a suspended ceiling system with a support frame member 14 supported above the main grid runner members of the suspended ceiling system. The invention herein is an improvement over the structure of the aforesaid patent.

U.S. Pat. No. 2,966,325 discloses a leveling and mounting device for a light fixture. This leveling and mounting device may be considered generally an outrigger which is collapsible against the body of the light fixture and movable to an operative position extending outwardly from the light fixture.

SUMMARY OF THE INVENTION

The invention relates to a suspended ceiling for use with a room which has a main structural ceiling from which the suspended ceiling is suspended. The main grid assembly consists of a plurality of grid runner members arranged in a polygonal configuration forming plural modules and defining the lower plane of the suspended ceiling. Independent support means are connected to and carried by the main runner grid members in the lower ceiling plane. A support frame with outrigger means attached thereto is supported upon the independent support means positioned on the main runner grid members. Ceiling boards are then mounted within the support frame and positioned adjacent the support frame and main grid runner members to form a vaulted module fully enclosed by ceiling boards.

DESCRIPTION OF THE PREFERRED EMBODIMENT

The invention is primarily directed to a support frame 2 which is utilized in a conventional suspended ceiling system. A conventional ceiling system will consist of a number of main grid runners 4, 6, 8 and 10 arranged in a polygonal configuration forming an individual module. The plane of the main grid runners constitutes the lower plane of the suspended ceiling system. The overall ceiling system would be composed of a plurality of modules which may be of a vaulted appearance such as that shown in U.S. Pat. No. 3,581,448 or of a flat configuration wherein the ceiling boards all lie within the same plane. When a vaulted configuration is utilized for a module, the support frame 2 herein may be utilized to form the vaulted configuration for a module and the structure herein is an improvement over the structure of U.S. Pat. No. 3,581,448.

Figure 2:
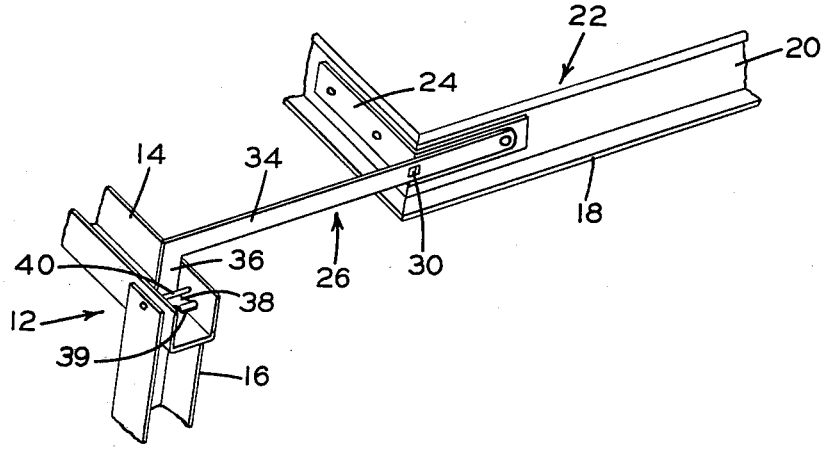
FIG. 2 is a perspective view of the support frame and its outrigger means in its operative position.

Support means or trusses 2 and 13 are placed on two adjacent main runner members 8 and 10. These truss means are similar to the truss means 22 of U.S. Pat. No. 3,581,488. They are simply three metal frame members, normally U-shaped, fastened together in an inverted "U" configuration with their ends placed upon the main grid runners. As best shown in FIG. 2, the truss 12 is formed of a horizontal member 14 which is generally of an upright U-shape and vertical members 16 (only one shown in FIG. 2) which are placed on each end of members 14. A rivet is utilized to fasten member 16 to member 14. The truss functions as a support platform for the support frame invention herein and positions the support frame at a certain distance spaced above the lower plane of the suspended ceiling system.

Figure 1:
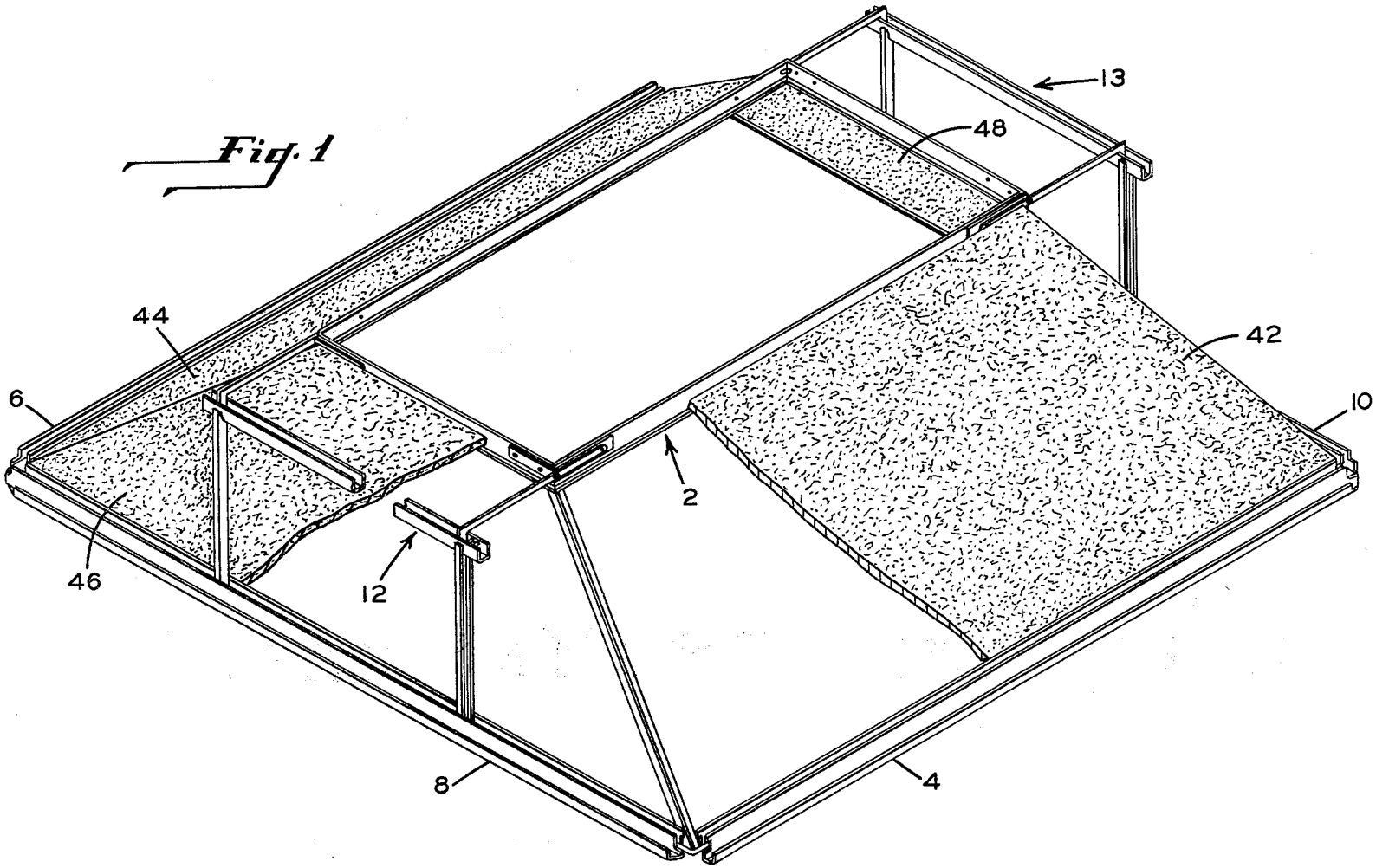
FIG. 1 is a perspective view of a suspended ceiling system according to the invention herein.
Figure 3:
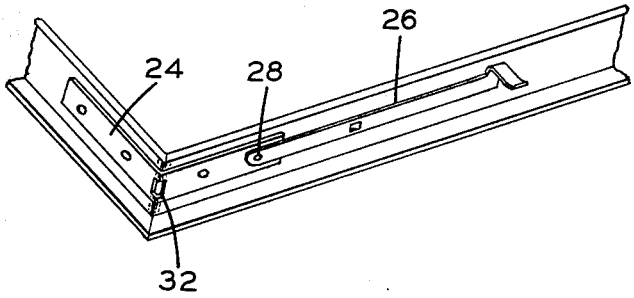
FIG. 3 is a perspective view of the support frame and its outrigger means in its inoperative position.

The support frame is of a polygonal configuration having four sides as shown in FIG. 1. It is normally made from the same type of runner members utilized to form the main runners of a conventional suspended ceiling system. These main runners have a generally inverted T-shape with a horizontal flange 18 and a vertical web 20 positioned intermediate of the horizontal flange. Consequently, there are flanges 18 on both sides of the vertical web 20. Four runner elements 22 are positioned together in a polygonal configuration to form the support frame. They are fastened together by conventional corner brackets 24 which are fastened to the vertical web 20 of the runner 22 through the use of rivets or other conventional fastening means. Thus, the four runners 22 are formed into a rigid polygonal configuration with the cross-section of the runners having an inverted T configuration. The length and width dimensions of the support frame are less than the length and width dimensions of the module formed by main runners 4, 6, 8, and 10. Outrigger means 26 are pivotally connected at point 28 to the support frame at the four corners thereof. The outrigger means is movable from the inoperative position shown in FIG. 3 to the operative position shown in FIG. 2. When the outrigger means 26 are extended into their operative position, they extend out beyond the ends of the support frame and engage the trusses 12 on two adjacent main runner members. Consequently, the outrigger means 26 extend beyond the support frame and function as the means to support the support frame on the trusses 12 with the support frame in a plane spaced above the lower plane of the suspended ceiling system. In affect, the support frame forms the upper plane of the suspended ceiling system wherein the module of the suspended ceiling system is formed as a vaulted module.

The outrigger means 26 are provided with lances 30 which engage apertures 32 in the support frame to lock the outrigger means in its operative position. The lance 30 is nothing more than a piece of metal pushed out from the body of the outrigger means and the end of the pushed out piece of metal slides into the aperture 32 to lock the outrigger means in position. The outrigger means 26 is primarily composed of a pivotally mounted long arm member 34 which has on the end thereof a generally L-shaped element composed of leg 36 and leg 38. Leg 36 is at a right angle to arm 34 and extends downwardly and then leg 38 extends perpendicular to leg 36 at a right angle thereto so that it is in generally the plane of the support frame. The leg 38 slips under the rivet 40 which holds members 14 and 16 together in the truss structure 12. Consequently, the outrigger means 26 not only rest on truss 12 to support the support frame 2 in position, but the leg 38 of the outrigger means locks the outrigger means to the truss 12. The leg 38 terminates in an upstanding projection 39 which coacts with rivet 40 to prevent leg 38 from being readly moved off the upper portion of truss 12.

The outrigger means may be collapsed to permit the support frame to be compactly packed for shipping. On the job site, the outrigger means would be swung to its operative position to permit the support frame to be mounted in position in the module of the suspended ceiling system. The main runner members 4, 6, 8, and 10 and the support frame 2 constitute the support means for the ceiling boards. Four trapezoidal ceiling boards 42, 44, 46, and 48 are placed within the ceiling module in an inclined position extending from the lower plane of the ceiling grid system to the upper plane of the ceiling grid system. The large side of the trapezoidal ceiling board rests upon one of the main runner structures 4, 6, 8, or 10, and the small side of the trapezoidal configuration of the ceiling board rests upon one of the flanges 18 of the support frame 2. Within the support frame 2 a polygonal ceiling board may be positioned to close in the vaulted configuration of the module. There is thus provided a ceiling system with a very good sound absorption rating, with a good fire rating and with a pleasing aesthetic effect.

What is claimed is:

1. A suspended ceiling for use with a room having a main structural ceiling from which said suspended ceiling is to be suspended comprising:

a. a main grid assembly consisting of a plurality of grid members arranged in a polygonal configuration forming plural modules and defining the lower plane of the suspended ceiling, b. independent support means connected to and carried by the grid members in the lower ceiling plane and being capable of carrying the weight of an upper ceiling element and the load placed thereon, c. a plurality of quadrilateral ceiling boards being carried by the grid members and the upper ceiling element, d. the improvement comprises said upper ceiling element being at least one polygonal configured support frame formed of small frame members and positioned above the lower ceiling plane, said smaller frame defining the upper ceiling plane, e. outrigger arm means being pivotally attached to said upper support frame and extending horizontally beyond the ends thereof to suspend said support frame from said independent support means and to position said upper support frame relative to a module formed by the grid members of the lower ceiling plane, and f. a polygonal ceiling board being mounted within said upper support frame constituting the upper plane of the ceiling system.

2. The improvement of claim 1 wherein said outrigger means comprise a plurality of arms pivotally attached to the sides of said support frame and capable of pivotal movement from a first position wherein said arms are positioned adjacent the sides of said support frame to a second position wherein said arms extend outward from the sides of said support frame a sufficient extent to engage a portion of the inependent support means for suspension of the support frame therefrom.

3. The improvement of claim 2 wherein said arms comprise locking means for holding said arms in their second position.

4. The improvement of claim 3 wherein said locking means comprises a tab extending angularly outward from each of said arms, apertures in said support frame, said tab being positioned on each of said arms so that it will project into an adjacent aperture in said support frame.

5. The improvement of claim 4 wherein the ends of said arms opposite the pivotally attached ends of said arms terminate with a leg extending angularly outward from one side of each of said arms 6. The improvement of claim 5 wherein the outermost ends of each of said legs terminate with an upstanding projection.

7. The improvement of claim 6 wherein the upper portion of said independent support means has generally horizontal fastening members for attaching a plurality of downwardly depending struts to said upper portion, said arms, when locked in their second position, having their legs positioned under said fastening members to prevent said arms from being moved off the upper portion of said independent support means, said projections at the ends of said legs coacting with said legs to further help prevent said arms from being moved off the upper portion of said independent support means.

* * * * *